United States Patent [19]

Suzuki et al.

[11] Patent Number: 4,544,288

[45] Date of Patent: Oct. 1, 1985

[54] IMPACT DOT PRINTING HEAD

[75] Inventors: Hirofumi Suzuki; Masahiko Waki; Kunimitsu Harada, all of Tanashi, Japan

[73] Assignee: Citizen Watch Co., Ltd., Tokyo, Japan

[21] Appl. No.: 554,817

[22] Filed: Nov. 23, 1983

[30] Foreign Application Priority Data

Nov. 29, 1982 [JP] Japan ..... 57-208811

[51] Int. Cl.[4] ..... B41J 3/10

[52] U.S. Cl. ..... 400/121; 400/124; 228/263.13

[58] Field of Search ..... 400/121, 124; 101/93.05, 93.04; 228/120, 122, 263.15, 263.13

[56] References Cited

U.S. PATENT DOCUMENTS 3,088,192 5/1963 Turner ..... 228/263.13
4,307,966 12/1981 Spencer et al. ..... 400/124

FOREIGN PATENT DOCUMENTS 2816455 10/1978 Fed. Rep. of Germany ..... 400/124
57-41974 3/1982 Japan ..... 400/124

*Primary Examiner*—Edgar S. Burr
*Assistant Examiner*—David A. Wiecking
*Attorney, Agent, or Firm*—Sherman & Shalloway

[57] ABSTRACT

An improved impact dot printing head in which a printing needle is secured more firmly to an armature than ever, particularly they are secured or soldered to each other at their mating portions by way of a solder material selected from nickel and nickel alloys, and a method of producing the printing head in which either an armature or a printing needle is plated, at least a mating portion thereof with the other, with such a solder material, and then they are assembled to each other and then the assembly is heated in a furnace so as to effect soldering of the printing needle to the armature with the solder material.

3 Claims, 4 Drawing Figures

IMPACT DOT PRINTING HEAD

BACKGROUND OF THE INVENTION

1. Field of the Invention

This invention relates to an impact dot printing head and a method of manufacturing of the same.

2. Description of the Prior Art

Generally, a main section of an impact dot printing head has a construction as shown in FIG. 1. In particular, a spring plate 5 is secured at one end thereof to a frame 1 by way of a spacer 2, a permanent magnet 3 and another spacer 4. Secured to a front face of the opposite free end of the spring plate 5 is an armature 6 made of a magnetic material such as free cutting mild steel and formed as a circular cylinder, and a printing needle 7 which is made of a wear proof material such as cemented carbide and formed as a thin circular cylinder is secured to the armature 6. A yoke 9 is held at one end thereof on the spring plate 5 by way of a spacer 8. The yoke 9 has a hole 9*a* formed therein into which the armature 6 extends with a little gap left therebetween. A core 10 is secured to the frame 1 and has one end face opposed to the rear face of the free end of the spring plate 5 and the free end of the spring plate 5 is attracted to the end face of the core 10 by magnetic attractive forces. A coil 11 is wound on the core 10 and is electrically connected to an electric circuit (not shown).

Conventionally, the printing needle 7 is secured to the armature 6 in a manner as seen in FIG. 2. In particular, the armature 6 has formed therein a positioning projection 6*a* in the form of a thin circular cylinder. In assembling, the printing needle 7 is inserted in position into a hole 6*b* formed at the center of the projection 6*a* of the armature 6. Then, a piece of silver solder is suitably placed between a front face of the projection 6*a* and an adjacent portion of a side face of the printing needle 7 of the assembly and is passed through a vacuum furnace to solder the printing needle 7 to the armature 6.

However, according to this invention, the printing needle 7 is soldered to the front face of the armature 6 as described hereinabove, and during passing the assembly through the furnace, melted solder will swell due to its surface tension. As a result, after cooled, the printing needle 7 will vary in diameter at a portion adjacent thereto because of the solder 12, resulting in the necessity of an operation for removing the excess solder. Also, since the solder 12 does not easily go into the hole 6*b* of the armature 6 and hence does not assure satisfactory soldering result, the solder 12 is easy to remove by a shock when the printing needle 7 is impacted against a platen, that is, when the spring plate 5 is impacted against the core 10 at a high speed, resulting in lack of reliability. Further, the solder 12 must first be formed in prior into a washer or into a ring from a coiled form of stock, and thus it takes a considerable time to shape the solder and to place the shaped solder 12 onto the armature 6, resulting in a rise of production costs of dot printing heads.

Moreover, the printing needle 7 which is required to be wear proof is made of a cemented carbide. Accordingly, because such a cemented carbide will oxidize and become broken if it is heated to or above a melting point of the solder 12 in atmospheric air, it must be soldered within a vacuum furnace as described above in order to prevent such breakage. However, since the armature 6 is made of a free cutting mild steel material, lead gas will generate from such free cutting mild steel if a soldering operation is performed within a vacuum furnace. Such lead gas will have the effect of raising the degree of vacuum while it adheres to an inside surface of the furnace to thereby further cause gas regeneration, leading to the lack of a soldering result of high reliability. In addition, generation of gas as described above causes deterioration of oil in a vacuum furnace.

In this way, such a conventional impact dot printing head as described above is disadvantageous in that it is inferior in quality and reliability and cannot be produced at a low cost.

SUMMARY OF THE INVENTION

It is an object of the present inention to provide an impact dot printing head which is excellent in quality and reliability and can be produced at a considerably reduced cost and to provide a method of production of such an improved impact dot printing head.

DETAILED DESCRIPTION OF THE INVENTION

Figure 1:
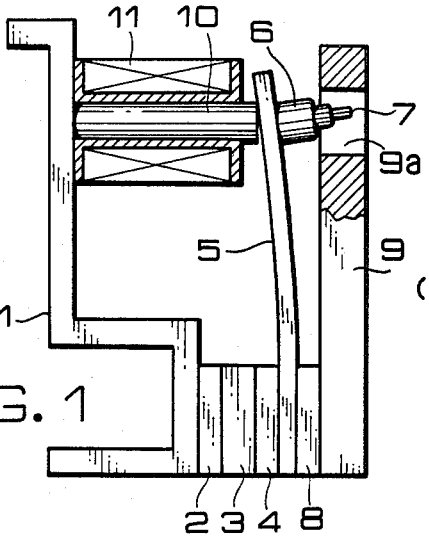
FIG. 1 is a cross sectional illustrative view of a portion of a typical impact dot printing head.
Figure 2:
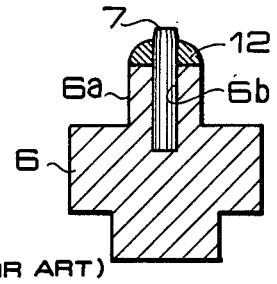
(PRIOR ART) FIG. 2
FIG. 2 is a cross sectional view showing a printing needle secured to an armature of such an conventional impact dot printing head.
Figure 3:
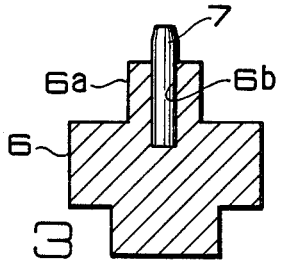
FIG. 3 is a cross sectional view of a printing needle secured to an armature of such an impact dot printing head of the present invention.
Figure 4:
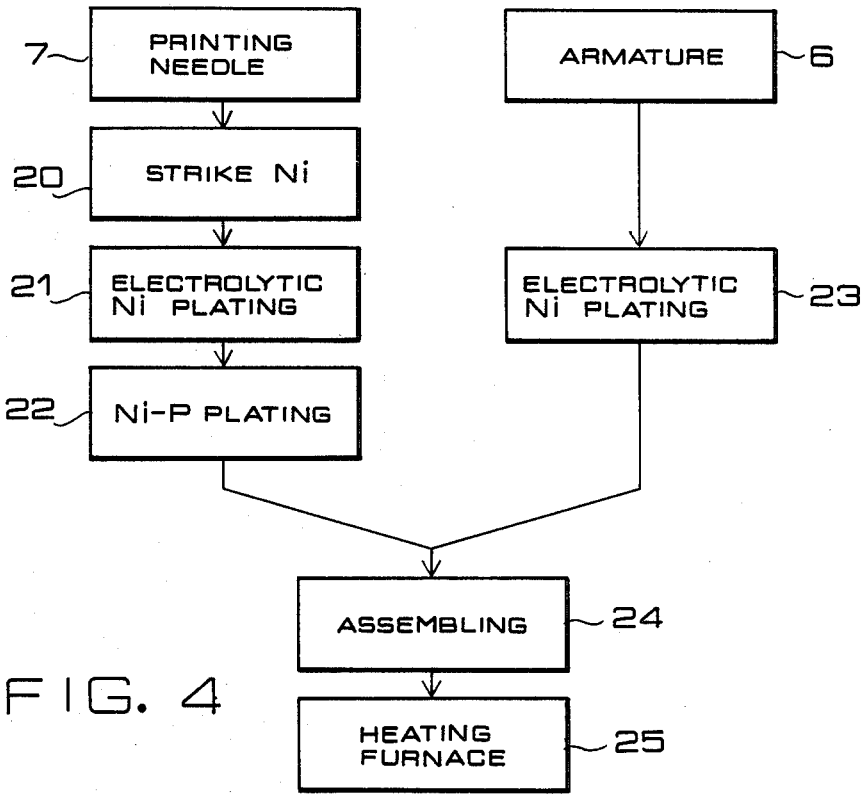
FIG. 4 is a flow chart showing separate steps of an embodiment of a method according to the present invention.

Reference is now had to FIGS. 3 and 4 which illustrate a first embodiment of the invention. In FIG. 3, like parts or members are designated by like reference numerals to those of FIG. 2. On one hand, a printing needle 7 is made of cemented carbide and has a layer of strike nickel 20 flash plated on a surface thereof as a foundation. A layer of electrolytic nickel plate 21 is then formed to a thickness of 1 to 3 μm (0.039–0.117 mill) on the strike nickel 20 whereafter a further layer of Ni-P solder plating 22 is formed to a thickness of about 5 to 15 μm (0.195–0.585 mill) by chemical nickel plating. On the other hand, an armature 6 is made of a free cutting mild steel and a layer of electrolytic nickel plating 23 is formed to a thickness of about 2 μm (0.078 mill) in order to improve adhesion to the Ni-P solder plating 22 of the printing needle 7.

The printing needle 7 and the armature 6 formed in this way are then assembled to each other (reference numeral 24, FIG. 4), that is, the printing needle 7 is inserted into a hole 6*b* of the armature 6. Then, this assembly is processed by heating for a period of about 20 minutes at a temperature of about 1,100° C. within a heating furnace 25 having an ammonia discomposing gas atmosphere therein. As a result, the armature 6 and the printing needle 7 are secured to each other at their mating portions by the material of the Ni-P solder plating 22 which exists in the hole 6*b* of the armature 6.

In this way, the method of the present invention eliminates operations for shaping solder and for placing shaped solder pieces. Further, since the armature 6 and the printing needle 7 are secured to each other at their mating portions by means of the Ni-P solder plating 22 and only a small amount of the Ni-P solder plating 22 is necessary, the quality of products becomes stabilized and there is no necessity for operations to remove excessive solder. Thus, the impact dot printing head of the present invention is advantageous as reducing production man-hours and production cost. In addition, since the armature 6 and the printing needle 7 are firmly secred to each other over entire surfaces of mating portions thereof, the Ni-P solder plating 22 will never be removed from the mating portions even by a shock and the reliability of such adhesion is very high. Moreover, since adhesion is attained with the Ni-P solder plating 22, assemblies of armatures and printing needles can be processed in a large amounts in a heating furnace, also leading to reduction of the production cost. Further, since soldering is performed within an ammonia dicomposing gas atmosphere, lead gas is not generated from the armature 6 which is made of a free cutting mild steel, and hence even if a vacuum furnace is used as such heating furnace 25, soldering results of high reliability can still be assured.

It is to be noted that, while in the embodiment described above the Ni-P solder plating 22 is formed on the printing needle 7, it may otherwise be formed on the armature 6. The Ni-P solder plating 22 need not be provided on the entirety of the printing needle 7 or the armature 6 but may be provided at least on a mating portion of the printing needle 7 or of the armature 6. Further, while the Ni-P solder plating 22 in the embodiment described above is provided by chemical plating, nickel solder plating can also be employed in place. However, in case of chemical plating, plating of a Ni-P binary alloy can be utilized in which the melting point is lower than that for pure nickel plating. Accordingly, there is little influence on materials and any other production steps, and hence the method of the invention is well suitable for mass-production, and besides even if an excessive amount of solder is applied, uniform thickness of the solder can still be assured and thus excellent effects can be attained.

As apparent from the foregoing description, according to the present invention, a printing head can be obtained which is improved in quality and reliability, and reduction of production cost can be attained.

What is claimed is:

1. In an impact dot printing head of the type in which an armature is secured to a front face of a free end of a spring plate which is supported at the opposite end thereof, and a printing needle is inserted into a hole formed in a front face of said armature, and secured thereto, the improvement wherein:

(a) said hole defines inner surfaces which are plated with nickel;

(b) said printing needle includes outer surfaces plated with nickel said nickel plating being chemically plated with a nickel-phosphorous alloy;

(c) said printing needle being located in said armature hole in assembled relation, said printing needle being soldered to said armature and said outer surfaces being soldered to said inner surfaces.

2. The invention of claim 1, wherein said armature is made of free cutting mild steel.

3. The invention of claim 1, wherein said needle is made of cemented carbide.

* * * * *